US011602914B2

(12) United States Patent
Andersson

(10) Patent No.: US 11,602,914 B2
(45) Date of Patent: Mar. 14, 2023

(54) METHOD AND BALER FOR PRESSING BALES OF MATERIAL

(71) Applicant: Presona AB, Tomelilla (SE)

(72) Inventor: Mats Andersson, Lomma (SE)

(73) Assignee: PRESONA AB, Tomelilla (SE)

( * ) Notice: Subject to any disclaimer, the term of this patent is extended or adjusted under 35 U.S.C. 154(b) by 55 days.

(21) Appl. No.: 16/975,404

(22) PCT Filed: Feb. 26, 2019

(86) PCT No.: PCT/EP2019/054699
§ 371 (c)(1),
(2) Date: Aug. 25, 2020

(87) PCT Pub. No.: WO2019/166417
PCT Pub. Date: Sep. 6, 2019

(65) Prior Publication Data

US 2021/0008824 A1 Jan. 14, 2021

(30) Foreign Application Priority Data

Feb. 28, 2018 (SE) ..... 1850223-7

(51) Int. Cl.
*B30B 9/30* (2006.01)
*B65B 27/12* (2006.01)

(52) U.S. Cl.
CPC ..... *B30B 9/3007* (2013.01); *B30B 9/301* (2013.01); *B30B 9/3078* (2013.01);
(Continued)

(58) Field of Classification Search
CPC ..... B30B 9/3007; B30B 9/301; B30B 9/3078; B30B 7/04; B30B 9/30; B30B 9/3021;
(Continued)

(56) References Cited

U.S. PATENT DOCUMENTS 4,162,603 A * 7/1979 Stromberg ..... B30B 9/301 53/438
4,476,779 A * 10/1984 Hasebe ..... B65B 13/20 100/7

(Continued)

FOREIGN PATENT DOCUMENTS

| | | | | |
|---|---|---|---|---|
| EP | 3001894 A1 | | 4/2016 | |
| GB | 2559155 A | * | 8/2018 | ..... B30B 9/3007 |
| SE | 432905 B | | 4/1984 | |

OTHER PUBLICATIONS

International Search Report and Written Opinion dated May 28, 2019 for PCT/EP2019/054699 filed on Feb. 26, 2019, 8 pages.

(Continued)

*Primary Examiner* — Jimmy T Nguyen
(74) *Attorney, Agent, or Firm* — Xsensus LLP

(57) ABSTRACT

A method for pressing bales of material in a baler is disclosed. The method comprises the steps of feeding the material into the baler through an inlet, pre-compressing the material under a number of compressing cycles by a first press, transporting the pre-compressed material by a transport unit into a second press, and compressing the pre-compressed material by the second press into a finished bale of compressed material. The step of transporting the pre-compressed material by a transport unit into a second press is conducted in a space of the baler, such that an undesirable expansion of the pre-compressed material can be prevented. A baler for pressing bales of material is also disclosed.

10 Claims, 5 Drawing Sheets

(52) U.S. Cl.
CPC ..... *B30B 9/3092* (2013.01); *B30B 9/3096* (2013.01); *B65B 27/125* (2013.01)

(58) Field of Classification Search
CPC ..... B30B 9/3014; B30B 9/3032; B30B 7/023; B30B 9/3092; B30B 9/3096; B65B 27/125; A01F 15/005
See application file for complete search history.

(56) References Cited

U.S. PATENT DOCUMENTS

| | | | | | |
|---|---|---|---|---|---|
| 4,936,206 | A * | 6/1990 | Miles | B30B 9/3057 | 100/219 |
| 5,001,974 | A * | 3/1991 | Gombos | A01F 15/005 | 100/6 |
| 5,558,014 | A * | 9/1996 | Robinson | | |
| 5,687,643 | A * | 11/1997 | Felts | | |
| 6,085,486 | A * | 7/2000 | Hunter | B30B 9/3007 | 100/17 |
| 6,823,776 | B1 * | 11/2004 | Olds | | |
| 2008/0141873 | A1 * | 6/2008 | Gerngross | | |
| 2015/0296714 | A1 * | 10/2015 | Dreher | | |

OTHER PUBLICATIONS

Decision to Grant a Patent received for Swedish Patent Application No. 1850223-7, dated Feb. 18, 2019, 2 pages.
Swedish search report dated Jun. 29, 2018, in corresponding Swedish patent Application No. 1850223-7, 3 pages.

* cited by examiner

METHOD AND BALER FOR PRESSING BALES OF MATERIAL

CROSS-REFERENCE TO RELATED APPLICATIONS

The present application is based on PCT filing PCT/EP2019/054699, filed Feb. 26, 2019, which claims priority to SE 1850223-7, filed Feb. 28, 2018, the entire contents of each are incorporated herein by reference.

TECHNICAL FIELD

The invention relates to a method for pressing bales of material in a baler and to a baler for pressing bales of material.

BACKGROUND ART

Bales of compressed material is normally manufactured in a bale press by compressing and pressing the material in question, normally in several steps. Thereafter each bale is packed and wrapped, which can take place in or outside the press.

U.S. Pat. No. 5,687,643 discloses an apparatus and method for producing strapped bales of highly compressible textile fibers is disclosed. The apparatus includes a supply chamber for supplying loose fibers to a tramping chamber which is stationary. A ram assembly repeatedly tramps loose fibers to form a compacted fiber mass which is then formed into a compressed fiber block within a stationary compression chamber disposed in fiber transfer relation to the stationary tramping chamber. The stationary tramping and compression chambers are off-set and the fiber mass is transferred through a transfer opening into the compression chamber. During the compression cycle, a new fiber mass may be tramped in the tramping chamber allowing a high production rate of strapped fiber bales. The compressed fiber block is formed between a movable main platen and a movable secondary platen which are axially aligned in the compression chamber. After compression, the compressed fiber block may be transferred into an alignment with a strapping and ejection opening in the strapping section also coaxial with the compression chamber.

U.S Pat. No. 6,823,776 discloses a system for baling of waste or other products having high output and having a sequenced method of operation. A previously formed bale formed in accordance with the invention is urged in incremental stages from a secondary bale chamber through a bale exit chamber and strapper for tieing in continuous and simultaneous progression while units of compressed waste are compressed together in sequenced steps first within a primary bale chamber and subsequently within a secondary bale chamber in the creation of a newly formed bale in continuous and simultaneous progression.

Swedish patent application 7705269-4 discloses a bale press of this kind. The pressing is carried out in several steps, and the final pressing of the bale takes place in a pressing chamber. The final pressing pressure thereafter is partially relieved so that the bale is permitted to expand. It is thereby possible to move the bale out of the pressing chamber to the packing and wrapping apparatus while maintaining said lower pressure, without giving rise to detrimental friction forces.

Australian patent application 199455070 discloses an improved baling machine for the compression and delivery for baling of compressible material. The machine comprises a first stage press for compressing said material to a smaller volume, a second stage press for further compressing said material, a delivery tube adjacent the position of said further compressed material, and an ejection ram opposite said delivery tube acting transverse to the axis of said second stage press for pushing said further compressed material through said delivery tube.

A drawback with the bale pressing machines described above is that they are bulky in size and the overall compressing process is quite slow since the capacity of the machines is low.

SUMMARY OF THE INVENTION

It is an object of the present invention to mitigate, alleviate or eliminate one or more of the above-identified deficiencies in the art and disadvantages singly or in any combination and solve at least the above mentioned problem.

According to a first aspect, these and other objects are achieved in full, or at least in part, by a method for pressing bales of material in a baler. The method comprises the steps of feeding the material into the baler through an inlet, pre-compressing the material under a number of compressing cycles by means of a first press, transporting the pre-compressed material by means of a transport unit into a second press, and compressing the pre-compressed material by means of the second press into a finished bale of compressed material. The method is characterised in that the step of transporting the pre-compressed material by means of a transport unit into a second press is conducted in a space of the baler, such that an undesirable expansion of the pre-compressed material can be prevented.

This is advantageous in that the connection between the first and the second press via the transport unit makes it possible to conduct all of the steps in the method in parallel which in turn increases the capacity of the baler. Also, the height of the baler can be kept to an absolute minimum.

It should be further noted that the space makes it possible to process light materials, such as PET-bottles, without experience the problem of the material expanding between the different steps of the process.

The step of pre-compressing the material under a number of compressing cycles by means of a first press may comprise measuring a pressure resistance from the material in at least one of the number of compressing cycles, and calculating an opening degree of the inlet based on the measured pressure resistance, in order to achieve an optimal volume of the pre-compressed material before being transported to the second press.

The number of compressing cycles material by means of a first press may be a predetermined number but it may also be a number that is based on the measured pressure resistance from the material during the first compression cycle by means of the first press.

The step of pre-compressing the material under a number of compressing cycles by means of a first press may be conducted in a first direction and the step of transporting the pre-compressed material by means of a transport unit into a second press may be conducted in a second direction, the second direction being substantially perpendicular to the first direction.

The step of pre-compressing the material under a number of compressing cycles by means of a first press may comprise pre-compressing the material against a side wall of the transport unit.

The step of compressing the pre-compressed material by means of the second press into a finished bale of compressed material may comprise compressing the pre-compressed material against a finished bale of material in the baler.

The step of pre-compressing the material under a number of compressing cycles by means of a first press, and the step of compressing the pre-compressed material by means of the second press into a finished bale of compressed material may be conducted in parallel.

The space may be defined at least by a side wall of the first press, a side wall of the second press and a side wall of the transport unit. In other words, the space may be limited by different walls of the baler and also by finished bales of material. This is highly important in order to avoid the pre-compressed material to expand back into its original configuration during transport between the first press and the second press.

The method may further comprise the step of strapping the finished bale of compressed material.

According to a second aspect of the invention, the objects are achieved in full, or at least in part, by a baler for pressing bales of material. The baler comprises an inlet for receiving material into the baler, a first press connected to the inlet and adapted to pre-compress the material under a number of compressing cycles, a second press adapted to compress the pre-compressed material into a finished bale of compressed material, and a transport unit adapted to transport the pre-compressed material from the first press into the second press. The baler is characterised in that the first press and the second press are connected to each other via the transport unit to create a space, such that an undesirable expansion of the pre-compressed material upon transport between the first press and the second press can be prevented.

The first press may be arranged below the inlet in the baler such that the movement of the first press controls an opening degree of the inlet.

The baler may further comprise a control unit connected to the first press and adapted to measure a pressure resistance from the material in at least one of the number of compressing cycles, and to calculate an opening degree of the inlet based on the measured pressure resistance, in order to achieve an optimal volume of the pre-compressed material before being transported to the second press.

The first press may be arranged to operate in a first direction and the transport unit is arranged to operate in a second direction, the second direction being substantially perpendicular to the first direction.

The first press and the second press may be arranged to operate in parallel.

The space may be defined at least by a side wall of the first press, a side wall of the second press and a side wall of the transport unit. In other words, the space may be limited by different walls of the baler and also by finished bales of material. This is highly important in order to avoid the pre-compressed material to expand back into its original configuration during transport between the first press and the second press.

The first press may be a shear baler and the second press is a main press.

Effects and features of the second and third aspects of the present invention is largely analogous to those described above in connection with the first aspect the inventive concept. Embodiments mentioned in relation to the first aspect of the present invention are largely compatible with the further aspects of the invention.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

The method may be used independently from the baler described in the present application. In other words, the method may be used in connection with any suitable type of baler.

It should also be noted that the first and second direction described herein may be varied in any suitable way.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1:
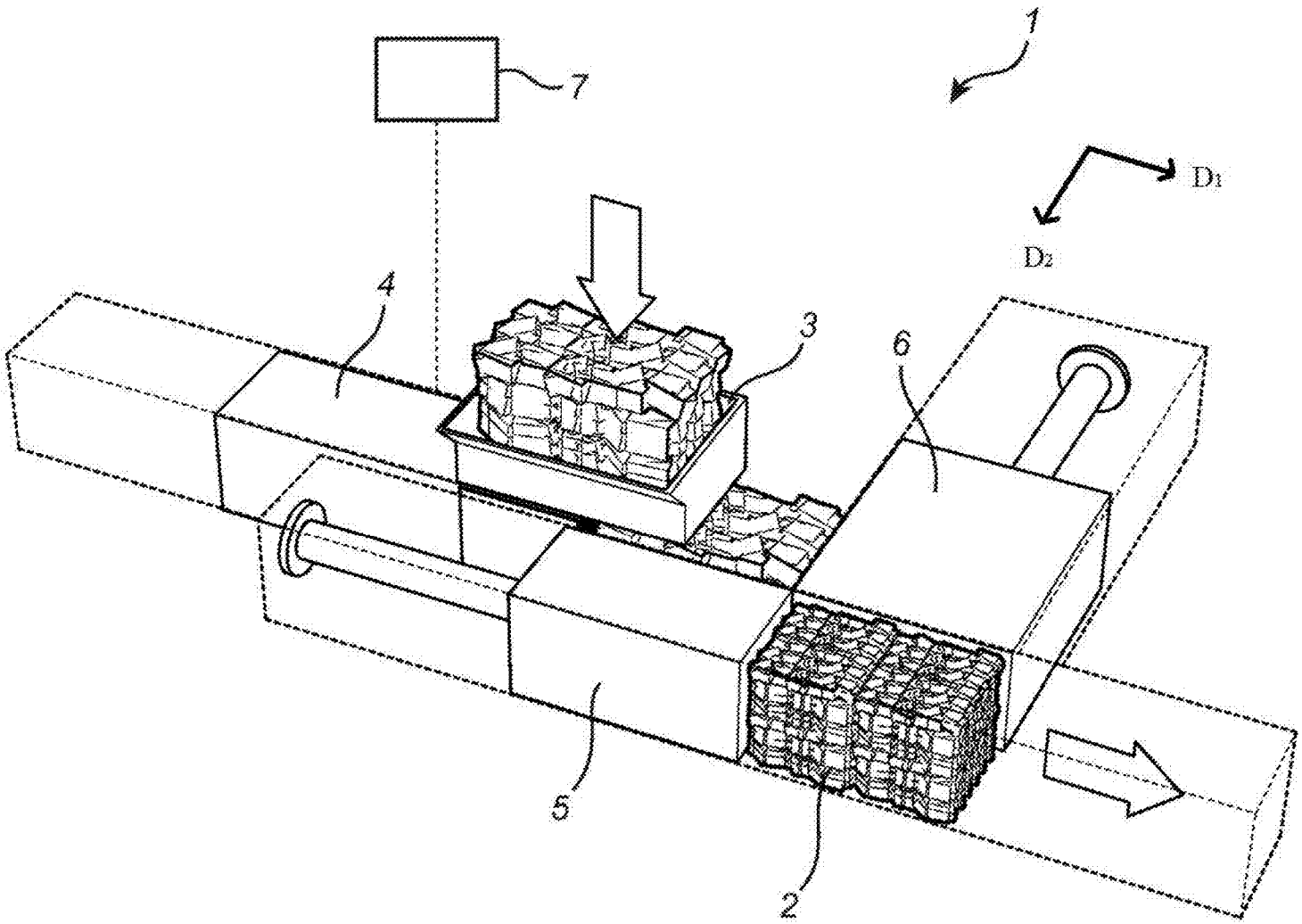
FIG. 1 is a perspective view of an exemplary baler for pressing bales of material according to a second aspect of the invention.

FIG. 1 illustrates one exemplary embodiment of a baler 1 for pressing bales 2 of material. The baler 1 comprises an inlet 3 for receiving material into the baler, a first press 4 connected to the inlet 3 which is adapted to pre-compress the material under a number of compressing cycles, and a second press 5 which is adapted to compress the pre-compressed material into a finished bale 2 of compressed material. The first press 4 is arranged below the inlet 3 in the baler 1 such that the movement of the first press 4 controls an opening degree of the inlet 3. A transport unit 6 is provided in connection with the first press 4 and the second press 5. The transport unit 6 is adapted to transport the pre-compressed material from the first press 4 into the second press 5.

In this embodiment, the first press 4 and the second press 5 are arranged to operate in a first direction $D_1$, and thus arranged to operate in parallel, and the transport unit 6 is arranged to operate in a second direction $D_2$. The second direction $D_2$ is substantially perpendicular to the first direction $D_1$. The first press 4 and the second press 5 are connected to each other via the transport unit 6 in order to create a space, such that an undesirable expansion of the pre-compressed material upon transport between the first press 4 and the second press 5 is prevented. The space is defined by at least a side wall of the first press 4, a side wall of the second press 5 and a side wall of the transport unit 6. Here, the space is further defined by side walls of the baler 1 and by a portion of a finished bale 2 of material.

The baler 1 further comprises a control unit 7 which is connected to the first press 4. The control unit 7 is adapted to measure a pressure resistance from the material in at least one of the number of compressing cycles, and to calculate an opening degree of the inlet 3 based on the measured pressure resistance, in order to achieve an optimal volume of the pre-compressed material in the first press 4 before being transported to the second press 5.

In FIG. 2A to 2F, the baler 1 is illustrated during the operation of pressing material into finished bales 2.

Figure 2B:
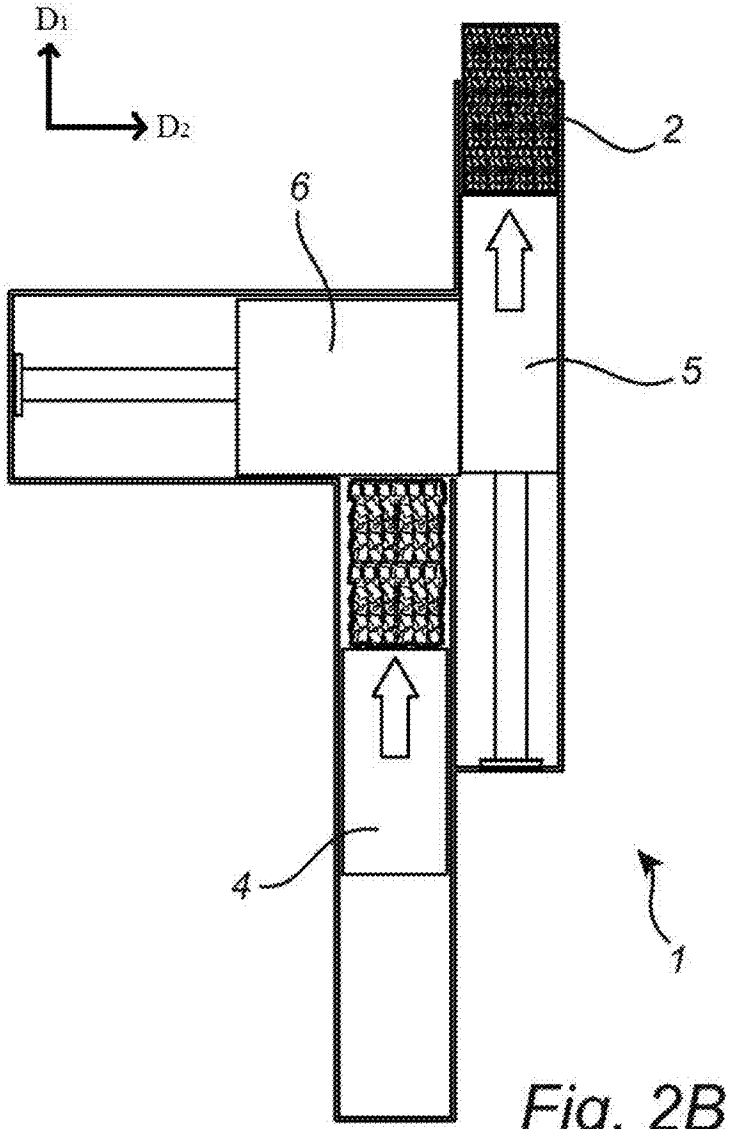
FIG. 2A to 2F are top views of the baler in FIG. 1 when performing an exemplary method for pressing bales of material in a baler according to a first aspect of the invention.
Figure 2A:
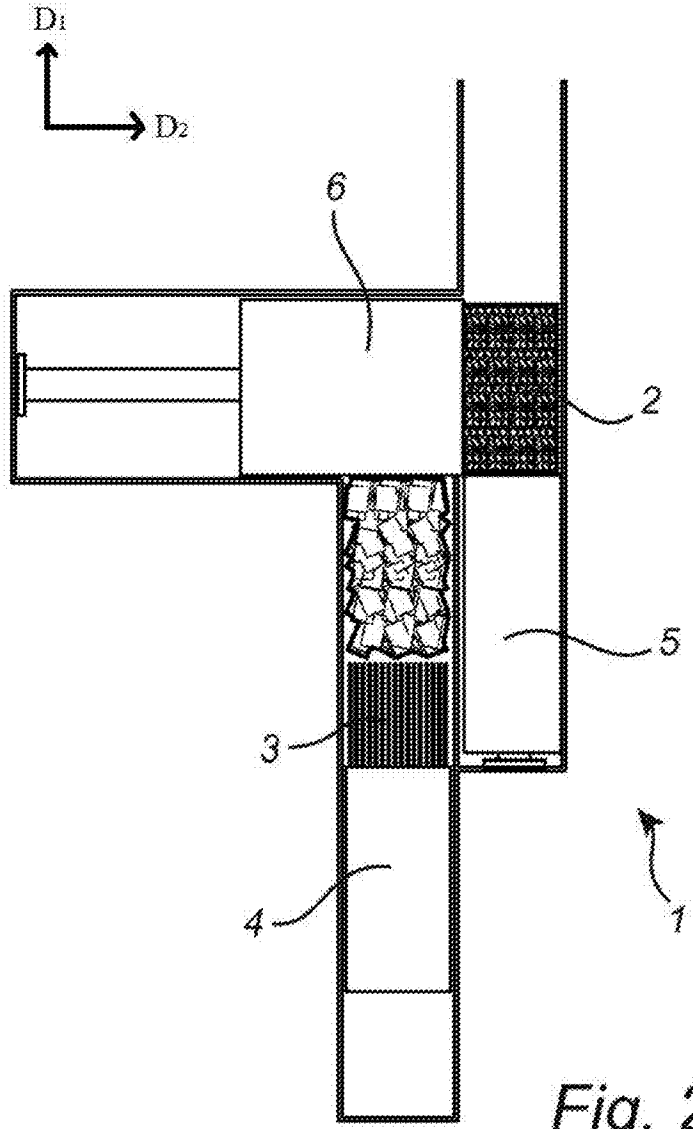

The material to be compressed is introduced into the baler 1 through the inlet 3 while the first press 4 is in an idle position (FIG. 2A). Thereafter, the first press 4 is moved in a first direction $D_1$ to press the material through a knife located at the further end of the inlet 3 and against the side of the transport unit 6 during a number of compression cycles to pre-compress the material and achieve a desired density of the pre-compressed material (FIG. 2B).

Figure 2D:
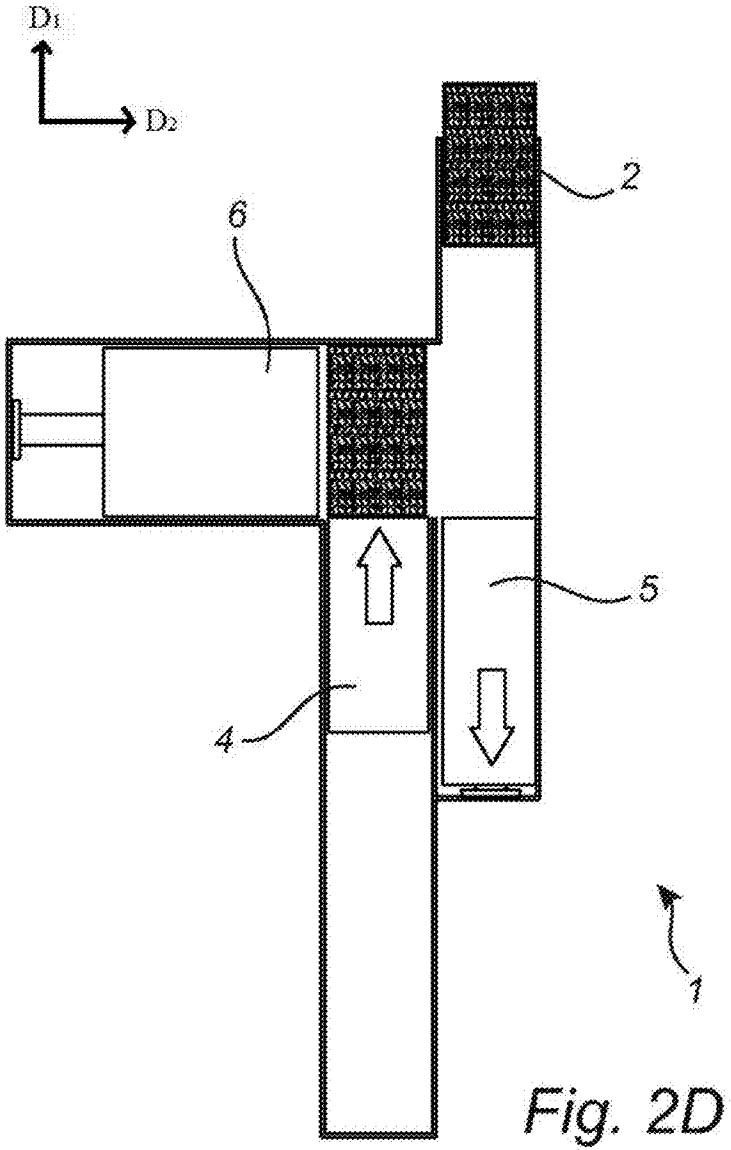
Figure 2C:
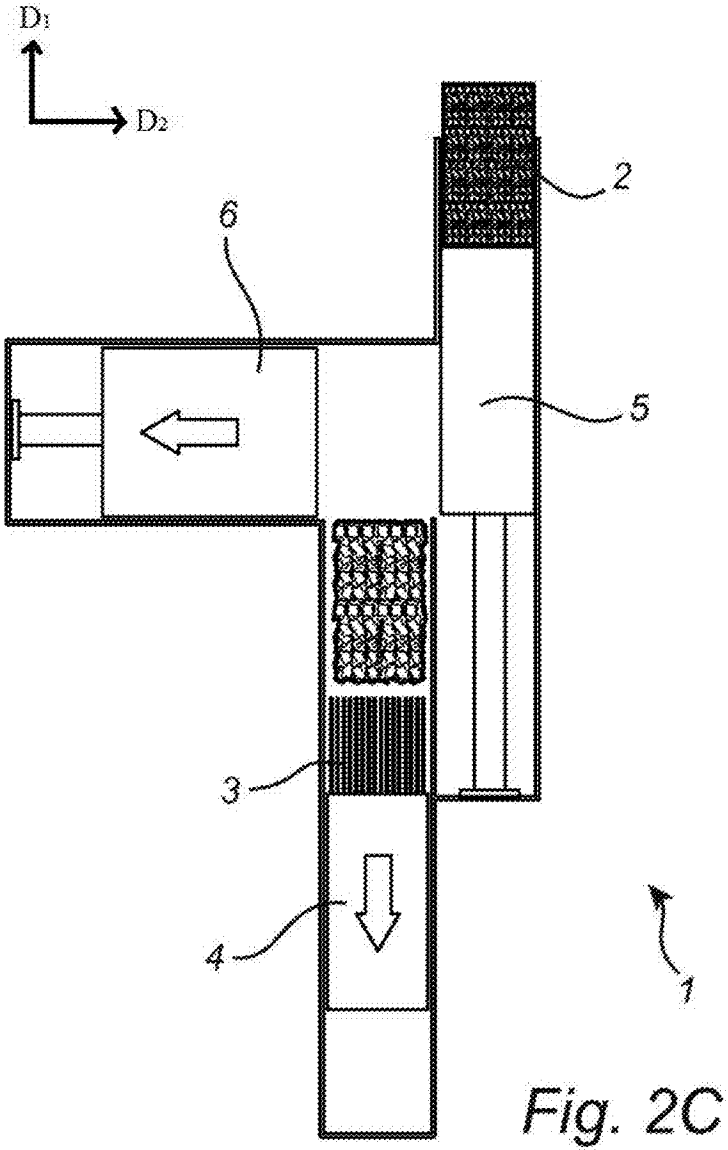
Figure 2E:
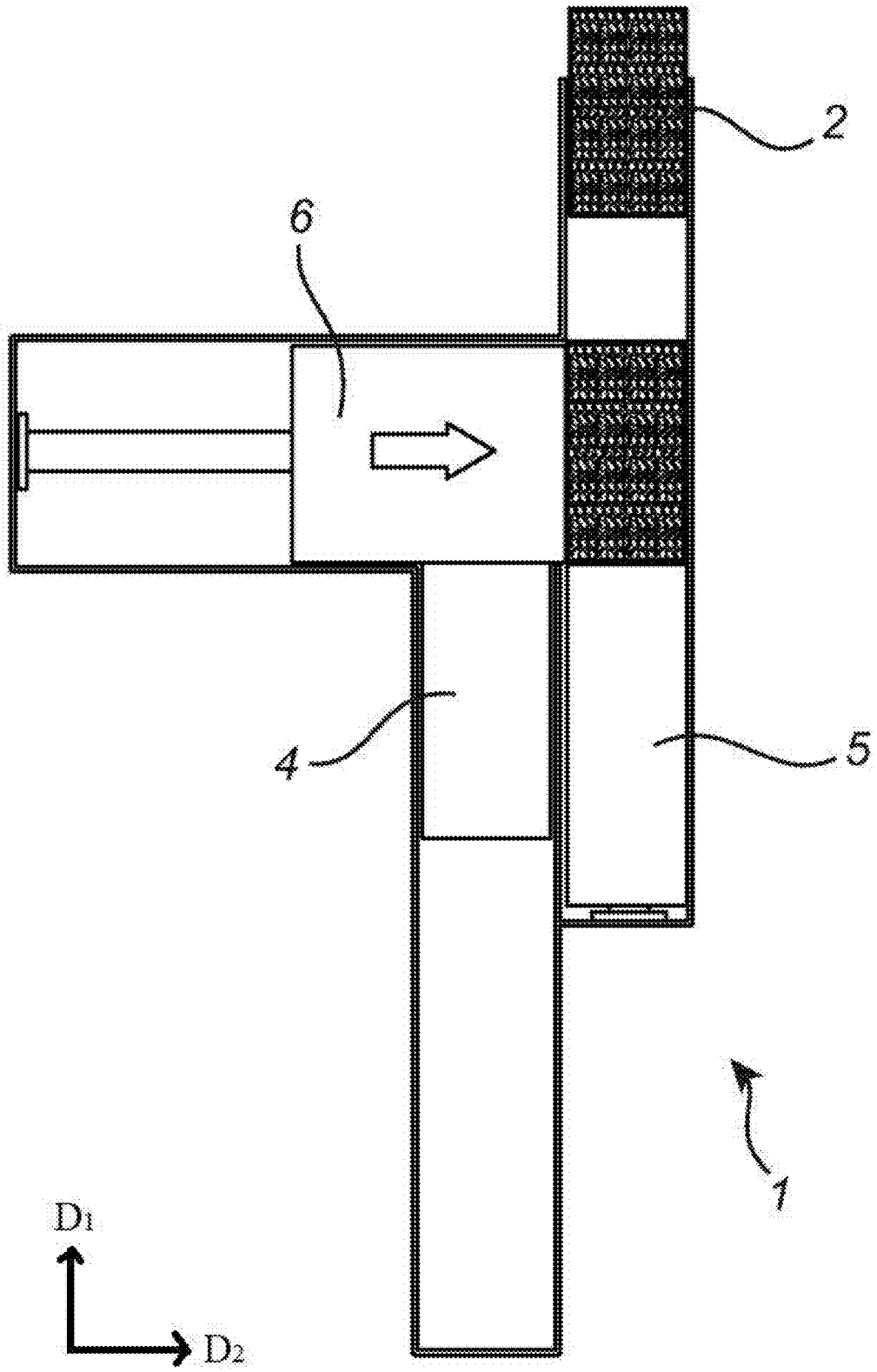
Figure 2F:
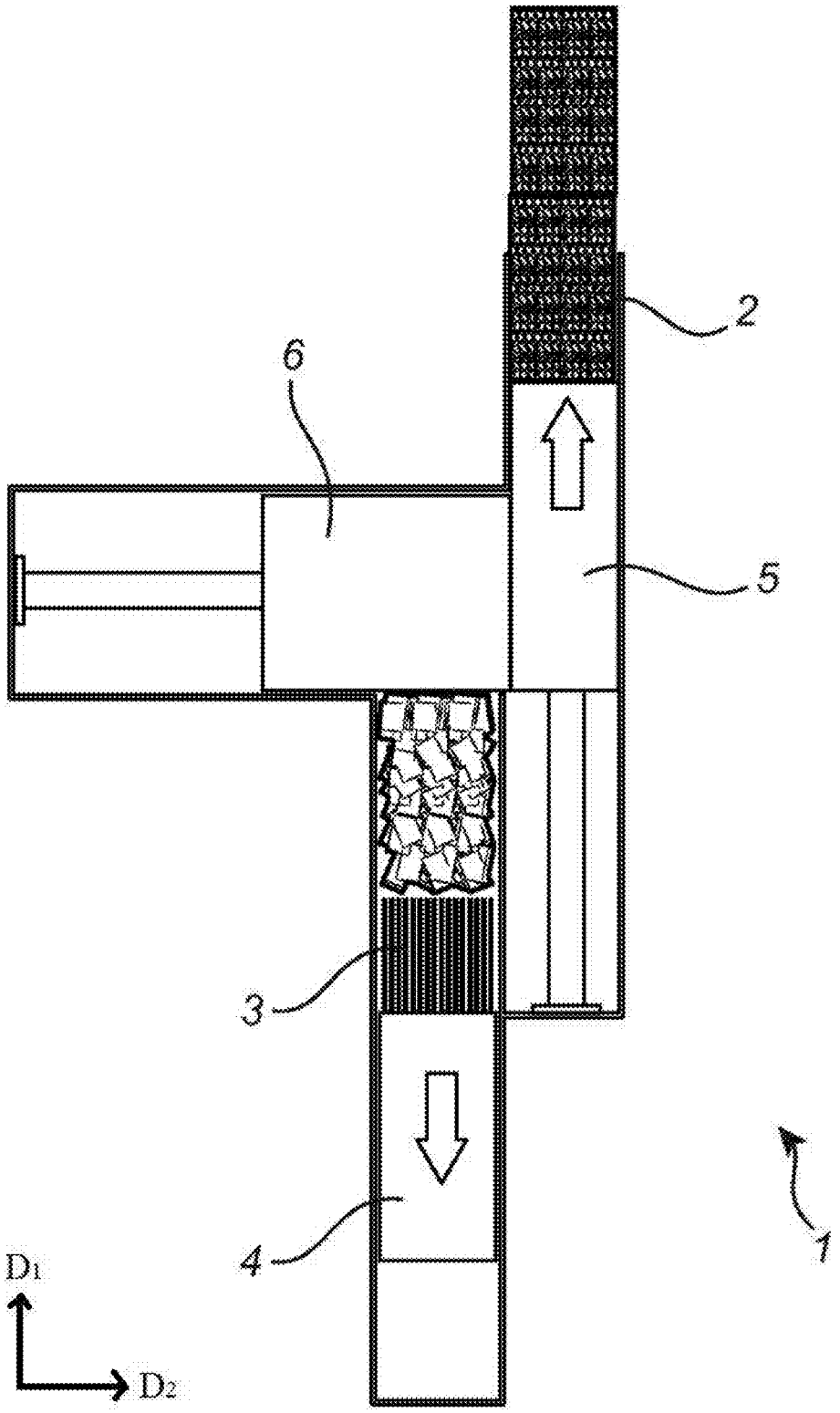

When the number of compressing cycles have been conducted, the transport unit 6 retracts into an idle position (FIG. 2C) and the first press 4 conducts a final pre-compression of the material against a further side wall of the transport unit 6 (FIG. 2D). Thereafter, the transport unit 6 transports the pre-compressed material in a second direction $D_2$ (FIG. 2E) into a second press 5 in which the pre-compressed material is compressed by means of the second press 5 against already compressed material into a finished bale 2 of compressed material (FIG. 2F).

The step of transporting the pre-compressed material by means of the transport unit 6 into a second press 5 is conducted in a space of the baler 1 which is limited in a way such that an undesirable expansion of the pre-compressed material can be prevented.

It is understood that other variations in the present invention are contemplated and in some instances, some features of the invention can be employed without a corresponding use of other features. Accordingly, it is appropriate that the appended claims be construed broadly in a manner consistent with the scope of the invention.

For instance, the size, shape and number of the components in the baler may be varied.

The first press 4 may be a shear baler and the second press 5 may be a main press. However, other arrangements are also possible.

The invention claimed is:

1. A method for pressing bales of material in a baler, the method comprising:

feeding the material into the baler through an inlet in an inlet direction and into a first chamber arranged perpendicular to the inlet direction;

pre-compressing the material in a first direction orthogonal to the inlet direction into a pre-compressed material, wherein the material is pre-compressed in the first chamber against a side wall of a transport unit under a number of compressing cycles by a first press while the side wall of the transport unit is positioned in front of the first press;

transporting the pre-compressed material by the transport unit into a second chamber in a second direction orthogonal to the inlet direction and orthogonal to the first direction, the second chamber comprising a second press; and compressing the pre-compressed material by the second press into a finished bale of compressed material, wherein the transporting the pre-compressed material into the second chamber is conducted in a limited space of the baler, such that a threshold expansion of the pre-compressed material is prevented, the pre-compressing the material includes measuring a pressure resistance from the material in at least one of the number of compressing cycles, and calculating an opening degree of the inlet based on the measured pressure resistance to achieve an optimal volume of the pre-compressed material before being transported to the second chamber, and controlling the first press for setting the calculated opening degree of the inlet, wherein movement of the first press controls the opening degree of the inlet.

2. The method according to claim 1, wherein the compressing the pre-compressed material into the finished bale of compressed material comprises compressing the pre-compressed material against another finished bale of material in the baler.

3. The method according to claim 1, wherein the pre-compressing the material and the compressing the pre-compressed material are conducted in parallel.

4. The method according to claim 1, wherein the limited space is defined at least by a first side wall of the first press, a second side wall of the second press and a third side wall of the transport unit used in the transporting the pre-compressed material into the second chamber comprising the second press.

5. The method according to claim 1, further comprising strapping the finished bale of compressed material.

6. A baler for pressing bales of material, the baler comprising:

an inlet for receiving material fed into the baler in an inlet direction;

a first chamber connected to the inlet and receiving the material from the inlet, the first chamber arranged perpendicular to the inlet direction, and the first chamber comprising a first press configured to pre-compress the material, in a first direction orthogonal to the inlet direction and into a pre-compressed material, wherein the material is pre-compressed in the first chamber under a number of compressing cycles;

a second chamber comprising a second press configured to compress the pre-compressed material into a finished bale of compressed material;

a transport unit configured to transport the pre-compressed material into the second chamber in a second direction orthogonal to the inlet direction and orthogonal to the first direction, wherein the first press configured to pre-compress the material against a sidewall of the transport unit while the side wall of the transport unit is positioned in front of the first press, and the pre-compressed material is transported by the transport unit from the first chamber into the second chamber in a limited space, such that a threshold expansion of the pre-compressed material is prevented; and a control unit connected to the first press, the control unit configured to:

measure a pressure resistance from the material in at least one of the number of compressing cycles, calculate an opening degree of the inlet based on the measured pressure resistance to achieve an optimal volume of the pre-compressed material before being transported to the second chamber, and control the first press for setting the calculated opening degree of the inlet, wherein movement of the first press controls the opening degree of the inlet.

7. The baler according to claim 6, wherein the first press is arranged below the inlet in the baler such that movement of the first press adjusts the opening degree of the inlet.

8. The baler according to claim 6, wherein the first press pre-compresses the material in parallel to the second press compressing the pre-compressed material.

9. The baler according to claim 6, wherein the limited space is defined at least by a first side wall of the first press, a second side wall of the second press and a third side wall of the transport unit.

10. The baler according to claim 6, wherein the first press is a pre-press and the second press is a main press.

* * * * *